US008393906B2

(12) United States Patent
Norman et al.

(10) Patent No.: US 8,393,906 B2
(45) Date of Patent: Mar. 12, 2013

(54) INTERACTIVE DOLL WITH TOY ACCESSORIES

(75) Inventors: Casey W. Norman, Gloucestershire (GB); David Gamlin, Bath (GB)

(73) Assignee: Genie Toys plc (GB)

( * ) Notice: Subject to any disclaimer, the term of this patent is extended or adjusted under 35 U.S.C. 154(b) by 0 days.

(21) Appl. No.: 13/095,405

(22) Filed: Apr. 27, 2011

(65) Prior Publication Data

US 2012/0276756 A1 Nov. 1, 2012

(51) Int. Cl.
*H01R 11/30* (2006.01)

(52) U.S. Cl. ..... 439/38

(58) Field of Classification Search ..... 439/38–40, 439/660, 305, 180; 446/297, 484, 268, 320, 446/319, 139
See application file for complete search history.

(56) References Cited

U.S. PATENT DOCUMENTS

| | | | | |
|---|---|---|---|---|
| 2,213,901 | A * | 9/1940 | Crawford | 446/139 |
| 4,025,964 | A * | 5/1977 | Owens | 623/11.11 |
| 4,267,551 | A | 5/1981 | Dankman et al. | |
| 5,277,643 | A * | 1/1994 | Ejima | 446/93 |
| 5,973,420 | A | 10/1999 | Kaiserman et al. | |
| 6,203,396 | B1 * | 3/2001 | Asmussen et al. | 446/376 |
| 6,386,937 | B1 * | 5/2002 | Cappello et al. | 446/139 |
| 6,554,679 | B1 * | 4/2003 | Shackelford et al. | 446/268 |
| 6,648,719 | B2 * | 11/2003 | Chan | 446/297 |
| 6,719,604 | B2 * | 4/2004 | Chan | 446/297 |
| 7,325,996 | B2 * | 2/2008 | Varner et al. | 403/24 |
| 7,384,325 | B2 * | 6/2008 | Kelly et al. | 446/268 |
| 7,588,478 | B2 | 9/2009 | Lashinsky | |
| 2003/0025504 | A1 | 2/2003 | Lam | |
| 2004/0127140 | A1 | 7/2004 | Kelly et al. | |
| 2006/0141899 | A1 | 6/2006 | Marine | |
| 2008/0014830 | A1 | 1/2008 | Sosnovskiy et al. | |
| 2008/0153594 | A1 | 6/2008 | Zheng | |

* cited by examiner

*Primary Examiner* — Alexander Gilman
(74) *Attorney, Agent, or Firm* — DLA Piper LLP (US)

(57) ABSTRACT

An interactive toy includes a doll and one or more compatible toy accessories. The doll is configured to hold each accessory, the holding action causing the particular accessory to operate according to its associated functionality. A socket unit is contained in and exposed from a doll, and includes a magnetic connector and a socket connector. A plug unit is contained in and exposed from an accessory, and includes a central connector and a plug connector. The socket unit and the plug unit are configured to engage one another. A battery source is connected to the socket unit, and an actuator is connected to the plug unit. The engagement between the socket unit and the plug unit causes power from the socket unit to be transferred to the plug unit, thereby causing the actuator to be actuated to perform the associated functionality of the accessory.

15 Claims, 5 Drawing Sheets

INTERACTIVE DOLL WITH TOY ACCESSORIES

TECHNICAL FIELD

This application is directed to interactive toys. In particular, this application is directed to a doll that interacts with various toy accessories, where contact between the doll and a toy accessory causes the accessory to perform a corresponding function.

BACKGROUND

Doll toys are well known and well liked by a large number of people, young and old. A popular concept includes creating various accessories for a doll, such as a doll car and doll cooking accessories. Such dolls and coordinating accessories, however, typically require control and/or imagination on the part of the person playing with the doll to effect any type of motion or performance from the accessories. For example, a child playing with a doll with a flashlight would typically be required to turn on the flashlight and carefully position in the doll's hand the flashlight, which may not be easily secured.

While interactive toys are known, they are often cumbersome while still requiring a significant amount of user interaction. Thus, an improved interactive doll is desired.

SUMMARY

We provide doll toys including a socket unit and a battery source that provides power to the socket unit. The socket unit is contained in and exposed from a portion of the doll and includes a magnetic connector and a socket connector. The socket unit is configured to engage a plug unit that is contained in a remote object. The plug unit includes a central connector and a plug connector. Engagement between the socket unit and the plug unit includes the magnetic connector and the central connector forming a magnetic attraction with one another, and the socket connector and the plug connector being in contact with one another. Moreover, the engagement between the socket unit and the plug unit causes power from the socket unit to be transferred to the plug unit.

We also provide an interactive toy including a doll and one or more accessories configured to interact with the doll. The doll includes a socket unit, contained in and exposed from a portion of the doll, with a magnetic connector and a socket connector. The doll also includes a battery source that is connectable to the socket unit for providing power thereto. One or more accessories are configured to interact with the doll, with each accessory having a plug unit with a central connector and a plug connector. The socket unit of the doll and the plug unit of each accessory are configured to engage one another to establish contact, where engagement includes the magnetic connector and the central connector forming a magnetic attraction with one another, and the socket connector and the plug connector in contact with one another. Moreover, the engagement between the socket unit and the plug unit causes power from the socket unit to be transferred to the plug unit.

We further provide an interactive toy including a doll and one or more accessories configured to interact with the doll. In this embodiment, the doll includes a socket unit, contained in and exposed from a portion of the doll, with a magnetic connector and a socket connector contained within a recess surrounding the magnetic connector. The doll also includes a battery source that is connectable to the socket unit for providing power thereto. One or more accessories are configured to interact with the doll, with each accessory having a plug unit with a central connector mounted on a flexible structure and a plug connector surrounding the central connector and protruding outward further from the central connector. Each accessory also include an actuator configured to perform an action associated with the accessory. The socket unit of the doll and the plug unit of each accessory are configured to engage one another to establish contact therebetween, where the plug connector is inserted into the recess surrounding the magnetic connector. The magnetic connector and the central connector form a magnetic attraction with one another that causes the flexible structure to deflect to provide contact between the socket connector and the plug connector. The engagement between the socket unit and the plug unit causes power to be transferred to the plug unit from the socket unit to cause the actuator to perform the action associated with the accessory.

BRIEF DESCRIPTION OF THE DRAWINGS

The foregoing summary and the following detailed description are better understood when read in conjunction with the appended drawings. Representative examples are shown in the drawings. However, it is understood that the examples are not limited to the specific methods and instrumentalities depicted herein. In the drawings.

DETAILED DESCRIPTION

An interactive toy may include a doll and one or more toy accessories that are compatible with the doll. The doll is configured to hold each accessory, and the holding action causes the particular accessory to operate according to its associated functionality. For example, when the doll holds a hair dryer, the hair dryer begins to operate; and when the doll holds a mixer, the mixer begins to move to mix ingredients.

Figure 1A:
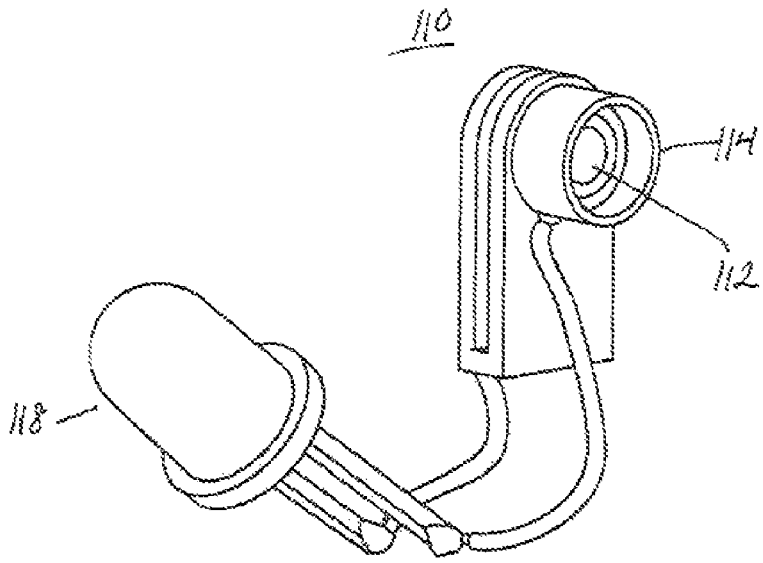
FIG. 1*a* is a perspective view of a plug unit.
Figure 1B:
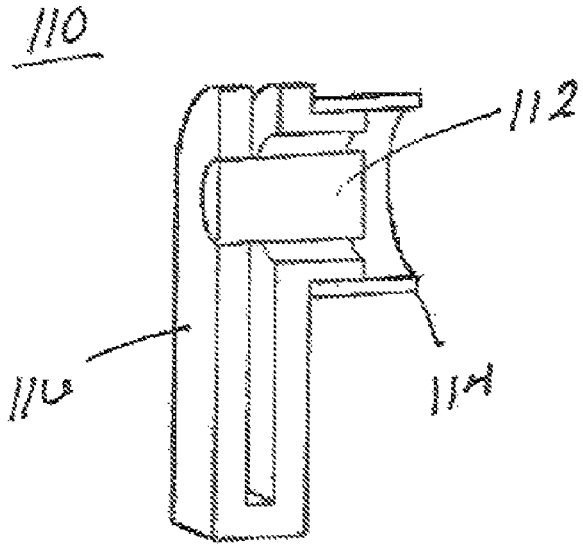
FIG. 1*b* is a side view of a plug unit.
Figure 1C:
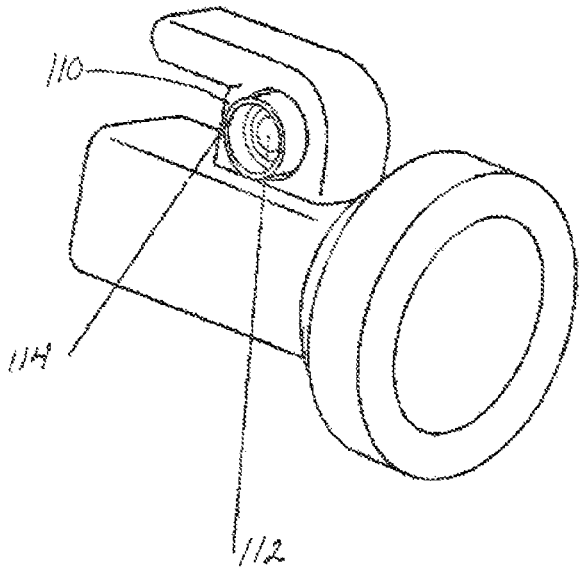
FIG. 1*c* is a perspective view of a plug unit contained within an accessory.

With reference to FIGS. 1*a*-1*c*, a plug unit 110 is illustrated. The plug unit 110 is contained within a toy accessory and is configured to interact with a doll. The plug unit 110 includes a central connector 112 and a plug connector 114. The central connector 112 may be a piece of iron, for example. The central connector 112 may be mounted on a piece of flexible material 116, such as flexible plastic or the like, for example. The piece of flexible material 116 may be disposed within the accessory, while the central connector 112 and the plug connector 114 protrude or are accessible from an outer portion of the accessory. The plug unit 110 is connectable to an actuator 118, which may be contained within the accessory.

Figure 2:
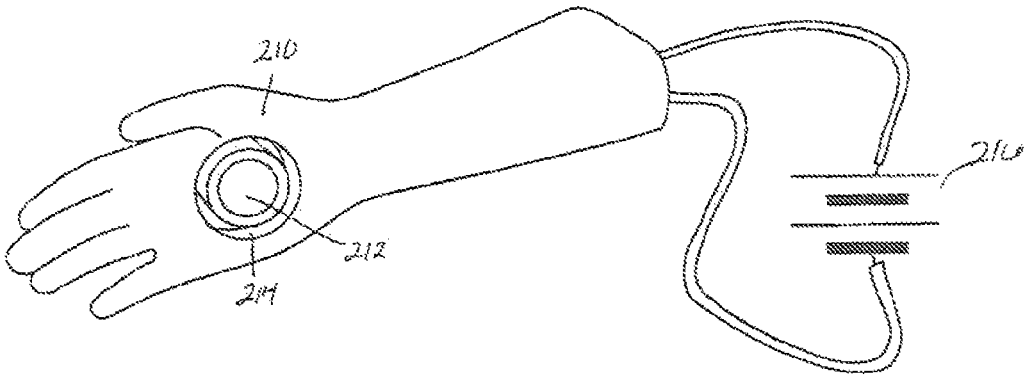
FIG. 2 is a perspective view of a socket unit.

FIG. 2 provides a perspective view of a socket unit 210. The socket unit 210 is contained, at least partially, within a doll to interact with one or more toy accessories. The socket unit 210 includes a magnetic connector 212, a socket connector 214, and a battery source 216 that connects to the socket unit 210 for providing power thereto. The battery source 216 is contained at least partially within the doll. The battery source 216 is accessible from an outer portion of the doll so that a battery may be removed and replaced. For example, the doll may have a removable cover on an obscure portion, such as its back, that makes the battery source 216 readily accessible.

The plug unit 110 and the socket unit 210 are configured to engage one another, where the engagement results in the doll holding the accessory, as well as the accessory operating according to its associated functionality. The engagement between the plug unit 110 and the socket unit 210 provides for the central connector 112 and the magnetic connector 212 to be attracted to one another due to the magnetic properties of the magnetic connector 212 and the material of the central connector 112. The engagement also includes the plug connector 114 and the socket connector 214 in contact with one another.

Figure 3A:
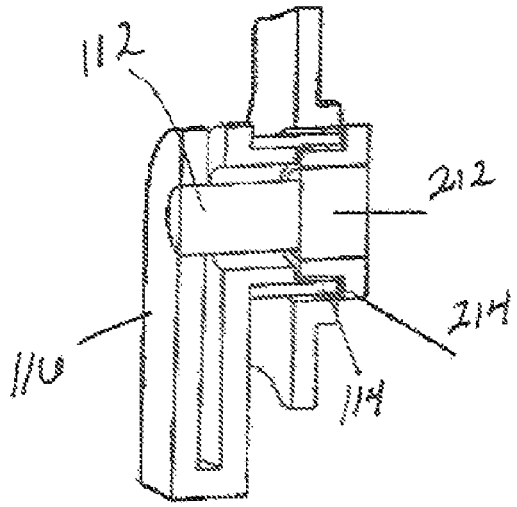
FIGS. 3*a* and 3*b* are perspective views of a plug unit and a socket unit engaged with one another.
Figure 3B:
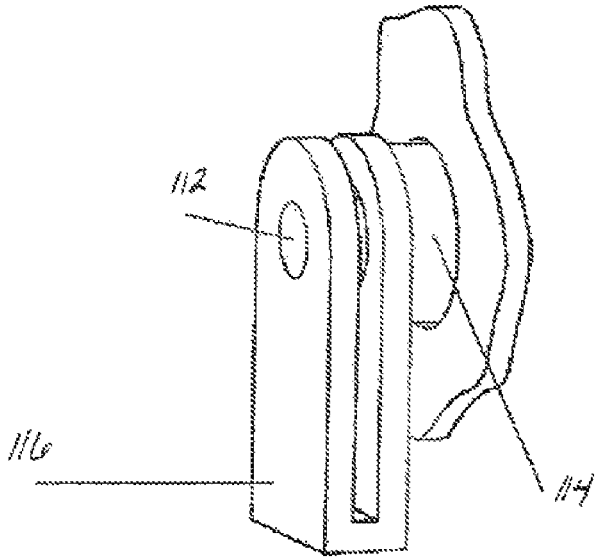

FIGS. 3*a* and 3*b* provide perspective views of the plug unit 110 and the socket unit 210 engaged with one another. In operation, a user of the doll and the accessory inserts the plug unit 110 of the accessory into the socket unit 212 of the doll. The insertion causes the central connector 112 and the magnetic connector 212 to be attracted to one another. The magnetic attraction causes the piece of flexible material 116 to deflect to provide contact between the plug connector 114 and the socket connector 214. According to an embodiment, the plug unit 110, may be loose-fitted within the accessory for flexible engagement with the socket unit 210.

Moreover, the engagement causes power from the battery source 216 of the socket unit 210 to be transferred to the plug unit 110. The transfer of power from the socket unit 210 to the plug unit 110 cause the actuator 118 within the toy accessory to actuate (i.e., perform an action associated with the accessory). The actuator 118 may be, for example, a motor or an integrated circuit chip. For example, an actuator 118 contained with a toy flashlight accessory, when provided with power, operates to light a bulb within the flashlight; and an actuator in a toy car includes a motor that operates to move the car.

The socket connector 214 may be contained with a recess that surrounds the magnetic connector 212, and the plug connector 114 surrounds the central connector 112 while protruding, or extending, outward further from the central connector 112. With such a configuration, the engagement between the socket unit 210 and the plug unit 110 is the result of the plug connector 114 being inserted into the recess surrounding the magnetic connector 212. Of course, other configurations are possible, such as, but not limited to, the socket connector 214 contained in a recess adjacent one side of the magnetic connector 212. A corresponding plug connector 114 is adjacent one side of the central connector 112 while protruding outward further from the central connector 112.

The configuration of the socket unit 210 in which the socket connector 214 is contained in a recess surrounding the magnetic connector 212 advantageously serves as a safety feature. Such a configuration, in which the plug unit 110 engages the socket unit 210 by being inserted into the recess, may be viewed as a sleeve connector where one unit (the plug unit 110) is inserted into the sleeve of the other unit (the socket unit 210). This configuration provides for the socket connector 214 of the doll to be recessed, thereby greatly reducing the possibility of an accidental short circuit of the doll contacts (the socket connector 214). Moreover, current at the doll contacts (the socket connector 214) may be restricted by including detection circuitry (not shown) within the doll that restricts current at the socket connector 214 to a predefined detection level before the accessory is plugged into the doll. The detection circuitry may also be able to detect if a short circuit occurs and respond by shutting down the doll (i.e., stopping power transfer from the battery source 216).

Figure 4A:
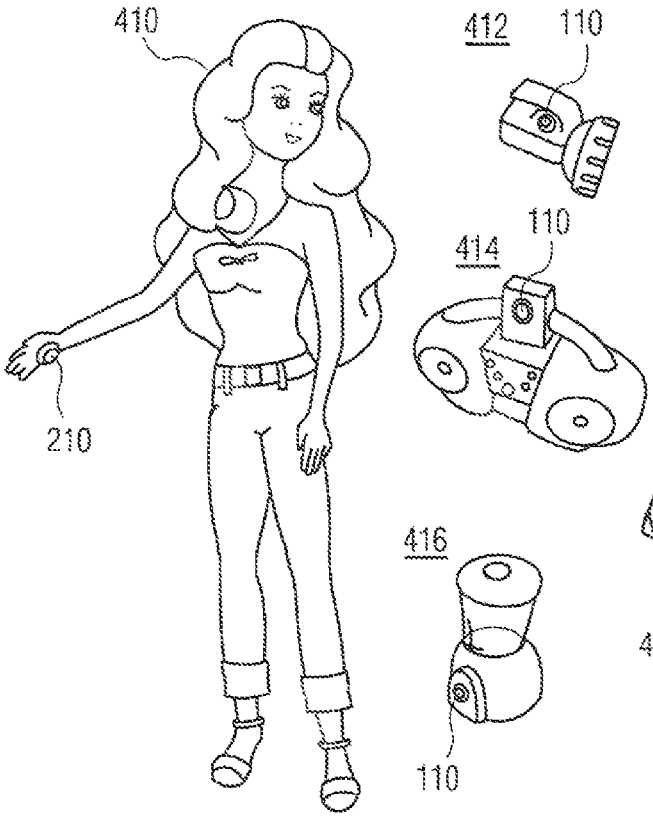
FIGS. 4*a* and 4*b* are exemplary views of an interactive toy.

With reference to FIG. 4*a*, a doll 410 and various accessories 412, 414, and 416 are shown. The doll 410 includes on the palm of its hand a socket unit 210 as described above. Each accessory 412, 414, and 416 includes a plug unit 110 as further described above. Within each accessory 412, 414, and 416 is a corresponding actuator (not shown) that operates to produce an associated functionality. For example, a blender includes an actuator that causes a toy blade in the blender to rotate, causing particles in the blender to move and producing a blending sound.

Figure 4B:
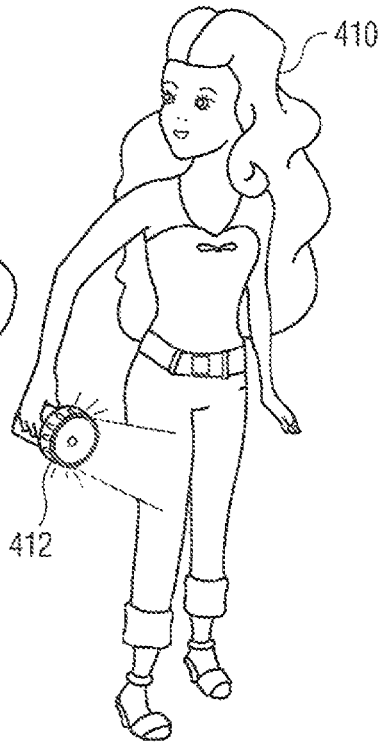

FIG. 4*b* shows the doll 410 with the accessory 412. The accessory 412 is securely positioned in the hand of the doll 410 by engaging the socket unit 210 and the plug unit 110. Moreover, the accessory 412 is operating merely by being in the hand of the doll 410, without requiring any extra effort on the part of the child or user of the doll 410 and the accessory 412.

One or more accessories, such as accessories 412, 414, and 416, may be recognizable by the doll 410 so that the doll further interacts with the given accessory. For example, if the doll 410 identifies the blender 416, the doll may perform one of several associated activities, such as talking about ingredients or turning on and off the blender 416.

Figure 5:
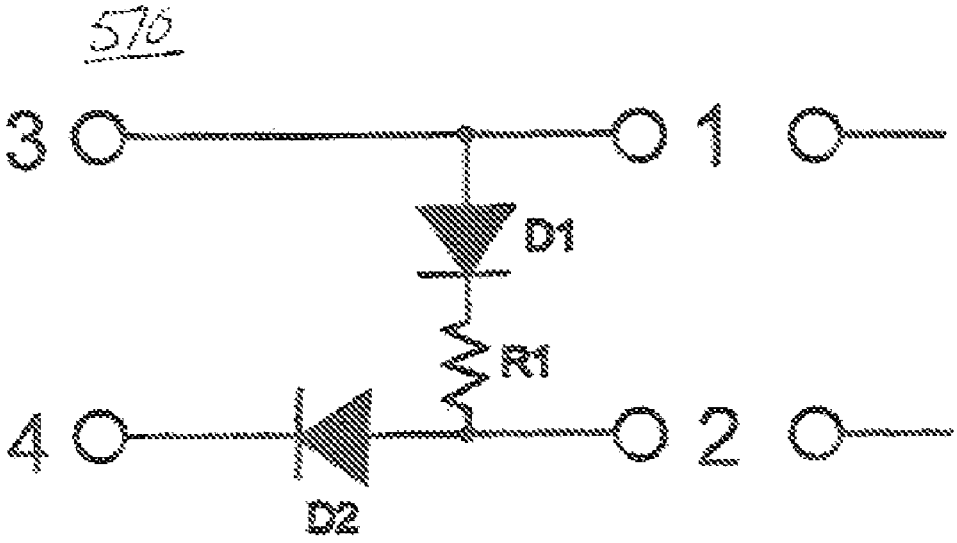
FIG. 5 is a diagram of an identification circuit for an accessory.

With reference to FIG. 5, an identification circuit 510 that may be included in an accessory for the doll to detect the presence of and identify the particular accessory is shown. A microcontroller circuit is contained in the doll. Contacts 1 and 2 represent contacts that are connected to the socket unit 210 of the doll, while contacts 3 and 4 represent contacts that are connected to the actuator 118 of the plug unit 110. In operation, before an accessory is inserted in the doll, contact 1 has a positive voltage applied, and contact 2 is connected to an analog to digital input on the microcontroller. The contact 2 may instead be connected to a capacitor-resistor timing circuit. Contacts 1 and 2 in the doll are connected via transistor switching circuits that are controlled by the microcontroller to adjust the polarity and connections to the microcontroller.

When an accessory is plugged into the doll, current flows through D1 and R1 to contact 2, to the microcontroller input. A second resister within the doll is connected from the input pin of the microcontroller to 0V to create a potential divider so that the voltage at the input is proportional to the value of R1. The value of R1 will differ for each accessory, thus the voltage at the analog to digital input will be unique for each particular accessory, making it identifiable to the microcontroller. At this time, current cannot flow between contacts 3 and 4, to the actuator 118, as D2 prevents the current flow.

When the microcontroller identifies the accessory, the microcontroller will cause the transistor switching circuits to apply positive voltage to contact 2 and 0V to contact 1. This applying of voltage may be delayed if desired to allow for, for example, the doll to perform an action before the accessory begins to function. With positive voltage applied to contact 2 and 0V to contact 1, current flows between contacts 3 and 4 and the actuator 118 will operate. The resistance of R1 will be removed from the circuit because current is not flowing through D1 at this time. After the operation of the accessory is complete, the polarity of the contacts will reverse again to test the value of R1. If the microcontroller identifies the same accessory, another interaction related to the accessory may occur, or the doll may not perform any action while waiting for a new accessory.

The foregoing examples are provided merely for the purpose of explanation and are in no way to be construed as limiting. While reference to the various examples are shown, the words used herein are words of description and illustration, rather than words of limitation. Further, although reference to particular means, materials, and examples are shown, there is no limitation to the particulars disclosed herein. Rather, the examples extend to all functionally equivalent structures, methods, and uses, such as are within the scope of the appended claims.

The invention claimed is:

1. An interactive toy, comprising:

a doll comprising:

a socket unit contained in and exposed from a portion of the doll, the socket unit comprising:

a magnetic connector; and a socket connector contained within a recess surrounding the magnetic connector a battery source connectable to the socket unit that provides power to the socket unit; one or more accessories that interact with the doll, each accessory comprising:

a plug unit comprising;

a central connector mounted on a flexible structure;

a plug connector surrounding the central connector and protruding outwardly from the central connector; and an actuator that performs an action associated with the accessory;

wherein the socket unit of the doll and the plug unit of each accessory to engage one another to establish contact therebetween;

wherein engagement between the socket unit and the plug unit comprises the plug connector being inserted into the recess surrounding the magnetic connector, the magnetic connector and the central connector forming a magnetic attraction with one another, and the magnetic attraction causing the flexible structure to deflect, thereby providing contact between the socket connector and the plug connector; and wherein the engagement between the socket unit and the plug unit causes power to be transferred to the plug unit from the socket unit to cause the actuator to perform the action associated with the accessory.

2. A doll that interacts with a plurality of accessories, comprising:

a socket unit contained in and exposed from a portion of the doll, the socket unit comprising:

a magnetic connector;

a socket connector; and a battery source connectable to the socket unit that provides power to the socket unit;

wherein 1) the socket unit engages a plug unit contained in a remote object, the plug unit comprising a central connector and a plug connector, 2) engagement between the socket unit and the plug unit comprises the magnetic connector and the central connector forming a magnetic attraction with one another, and the socket connector and the plug connector in contact with one another, 3) the engagement between the socket unit and the plug unit causes power to be transferred to the plug unit from the socket unit, and 4) the central connector is mounted on a flexible structure, and the magnetic attraction between the magnetic connector and the central connector causes the flexible structure to deflect, thereby providing the contact between the socket connector and the plug connector.

3. The doll of claim 2, wherein the socket connector is contained within a recess surrounding the magnetic connector, and wherein the plug connector surrounds the central connector and protrudes outward further from the central connector.

4. The doll of claim 3, wherein the engagement between the socket unit and the plug unit comprises the plug connector being inserted into the recess surrounding the magnetic connector.

5. The doll of claim 2, wherein the transfer of power to the plug unit causes an actuator within the remote object to actuate.

6. The doll of claim 2, wherein the plug unit is loose-fitted within the remote object for flexible engagement with the socket unit.

7. The doll of claim 2, wherein the battery source is contained at least partially within the doll.

8. The doll of claim 2, wherein the doll further comprises a microcontroller that detects the presence of and identifies the remote object.

9. An interactive toy, comprising:

a doll comprising:

a socket unit contained in and exposed from a portion of the doll, the socket unit comprising:

a magnetic connector; and a socket connector;

a battery source connectable to the socket unit that provides power to the socket unit;

one or more accessories that interact with the doll, each accessory comprising:

a plug unit comprising:

a central connector; and a plug connector;

wherein 1) the socket unit of the doll and the plug unit of each accessory engage one another to establish contact therebetween, 2) engagement between the socket unit and the plug unit comprises the magnetic connector and the central connector forming a magnetic attraction with one another, and the socket connector and the plug connector in contact with one another, 3) the engagement between the socket unit and the plug unit causes power to be transferred to the plug unit from the socket unit, and 4) the central connector is mounted on a flexible structure, and magnetic attraction between the magnetic connector and the central connector causes the flexible structure to deflect, thereby providing the contact between the socket connector and the plug connector.

10. The interactive toy of claim 9, wherein the socket connector is contained within a recess surrounding the magnetic connector, and the plug connector surrounds the central connector and protrudes outward further from the central connector.

11. The interactive toy of claim 10, wherein the engagement between the socket unit and the plug unit comprises the plug connector being inserted into the recess surrounding the magnetic connector.

12. The interactive toy of claim 9, wherein the transfer of power to the plug unit causes an actuator within the accessory to actuate.

13. The interactive toy of claim 9, wherein the plug unit is loose-fitted within the accessory for flexible engagement with the socket unit.

14. The interactive toy of claim 9, wherein the battery source is contained at least partially within the doll.

15. The interactive toy of claim 9, wherein the doll farther comprises a microcontroller that detects the presence of and identifies one or more of the one or more accessories.

* * * * *